US005178127A

United States Patent [19]

Flori et al.

[11] Patent Number: 5,178,127

[45] Date of Patent: Jan. 12, 1993

[54] FLARE FITTING TO PUMP OF OIL BURNER FOR RECEIVING BLOW OUT TOOL

[76] Inventors: Angelo Flori, 219 Beverly Rd., Douglas Manor, N.Y. 11363; Daniel Flori, One North Dr., New Hyde Park, N.Y. 11040

[21] Appl. No.: 586,663

[22] Filed: Sep. 24, 1990

[51] Int. Cl.[5] ..... F24H 3/00; B08B 3/00

[52] U.S. Cl. ..... 126/99 R; 134/166 C; 15/406

[58] Field of Search ..... 431/3, 265; 15/406; 184/1.5; 126/99 R, 116 R; 4/255; 134/166 C; 137/237, 242, 246, 560, 565

[56] References Cited

U.S. PATENT DOCUMENTS

| | | | |
|---|---|---|---|
| 578,142 | 3/1897 | Fierz | 137/237 |
| 1,661,972 | 3/1928 | Shadid . | |
| 2,500,787 | 3/1950 | Lelgemann | 431/265 |
| 2,534,618 | 12/1950 | Moore, Jr. | 126/99 R |
| 2,564,402 | 8/1951 | MacArthur . | |
| 2,999,264 | 9/1961 | Stearns . | |
| 3,119,141 | 1/1964 | Nuttal | 15/406 |
| 3,156,584 | 11/1964 | Yurdin | 134/166 C |
| 3,362,640 | 1/1968 | Fainman . | |
| 3,789,861 | 2/1974 | Conn et al. | 15/406 X |
| 3,934,303 | 1/1976 | Neithercutt . | |
| 4,063,317 | 12/1977 | Santore | 15/406 X |

*Primary Examiner*—Larry Jones
*Attorney, Agent, or Firm*—Nolte, Nolte and Hunter

[57] ABSTRACT

Means and method to reconstruct the terminal end of the fluid line adjacent the pump of an oil furnace to provide a coupling that may be opened to receive the delivery end of a pressure fluid gun to substantially eliminate oil seepage and the necessity of twice closing and reopening the normally open valve adjacent the reservoir.

5 Claims, 2 Drawing Sheets

FLARE FITTING TO PUMP OF OIL BURNER FOR RECEIVING BLOW OUT TOOL

FIELD OF THE INVENTION

This invention relates primarily to unplugging fuel line pipes communicating a reservoir tank to the pump or other devices in a furnace.

BACKGROUND OF THE INVENTION

In fuel pipes of the type described, it is frequently necessary to blow back by fluid under pressure plugs in the delivery pipe line from an oil tank reservoir. It is the present practice in structures of the type described to have a valve at the oil tank (distant valve) and a valve (near valve) near the so-called "rigid" pipe leading to the pump. In order to clean the fuel line, the distant valve near the oil tank is closed and the fuel pipe disconnected from the near valve. This has several disadvantages including the need (1) to close the distant valve near the reservoir (2) open the pipe at the near valve, and (3) subsequently open the distant valve for the cleaning operation. This procedure must then be reversed. Meanwhile oil leaks out of the fuel pipe creating a messy situation. Furthermore, most fuel line pipes rest on the ground which makes attaching the blow-out tool difficult.

It is an object of the present invention to obviate all these problems by providing a union having a flared end between the near valve and the pump to which a blow-out tool may be attached when the union is opened. It is a further object to provide a raised entry off the ground and near the pump for attaching a blow-out tool.

BRIEF DESCRIPTION OF THE DRAWINGS

Referring to the drawing.

DETAILED DESCRIPTION OF THE DRAWINGS

Figure 1:
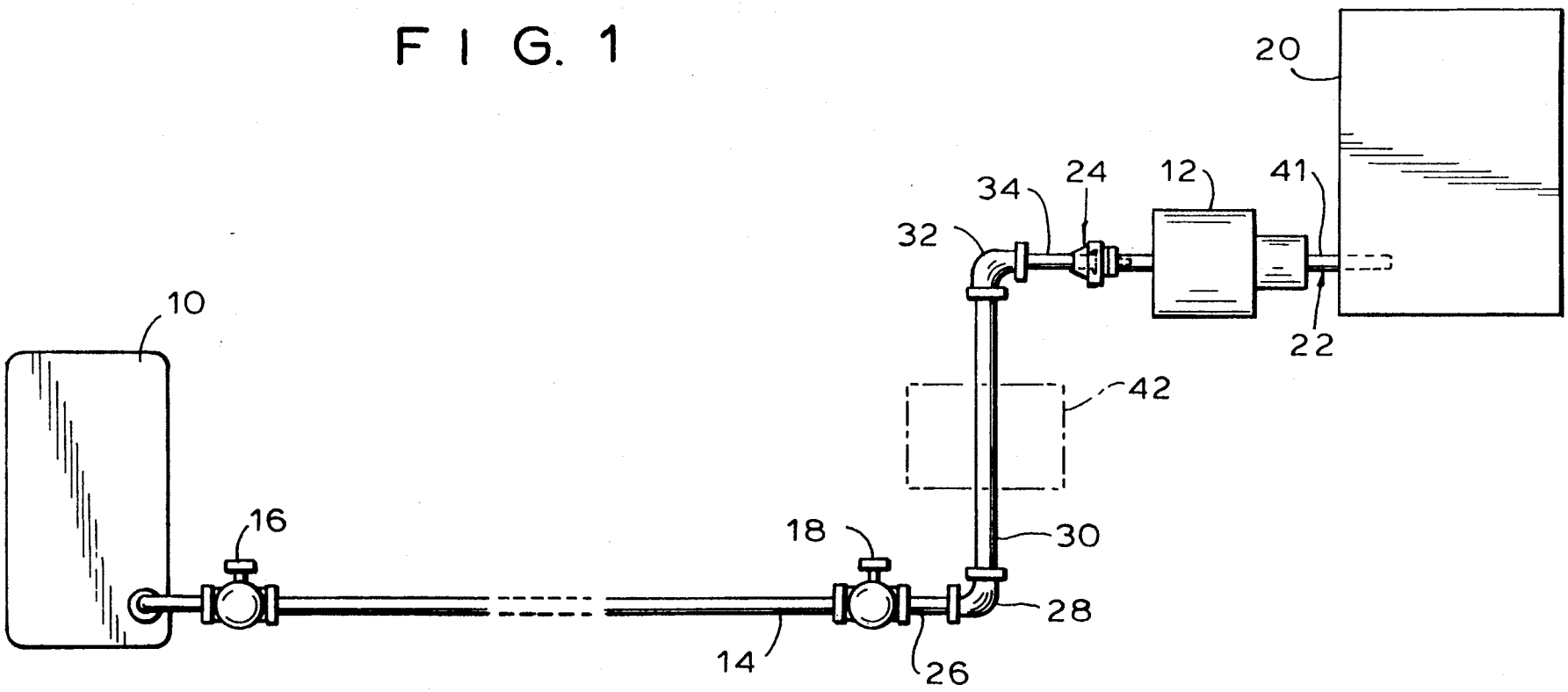
FIG. 1 shows the environment in which the invention is practiced.
Figure 2:
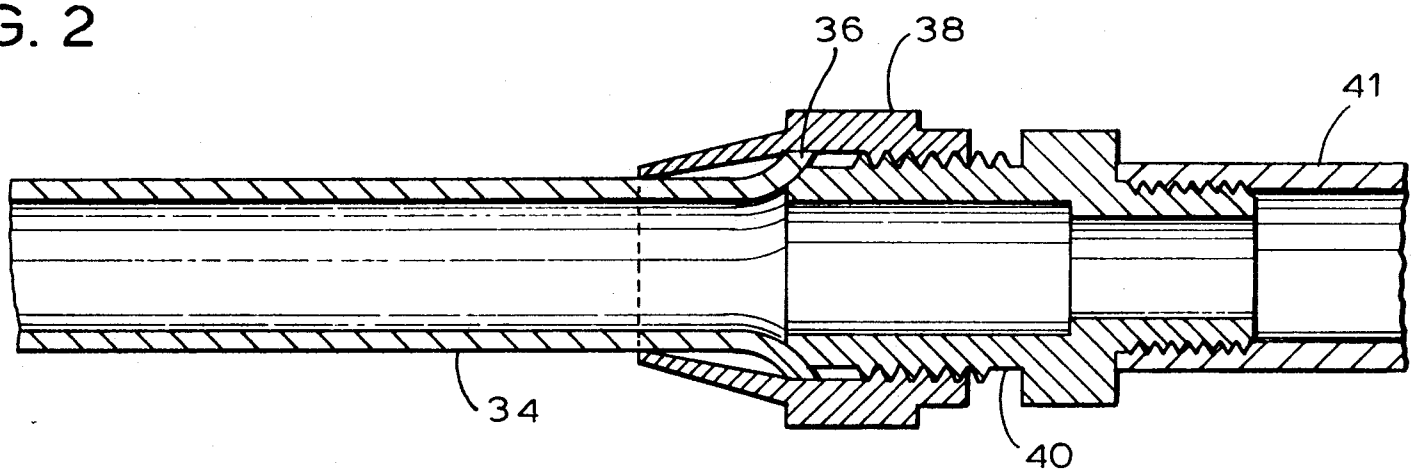
FIG. 2 is an enlarged fragmentary section of the pipe fitting assembly.
Figure 3:
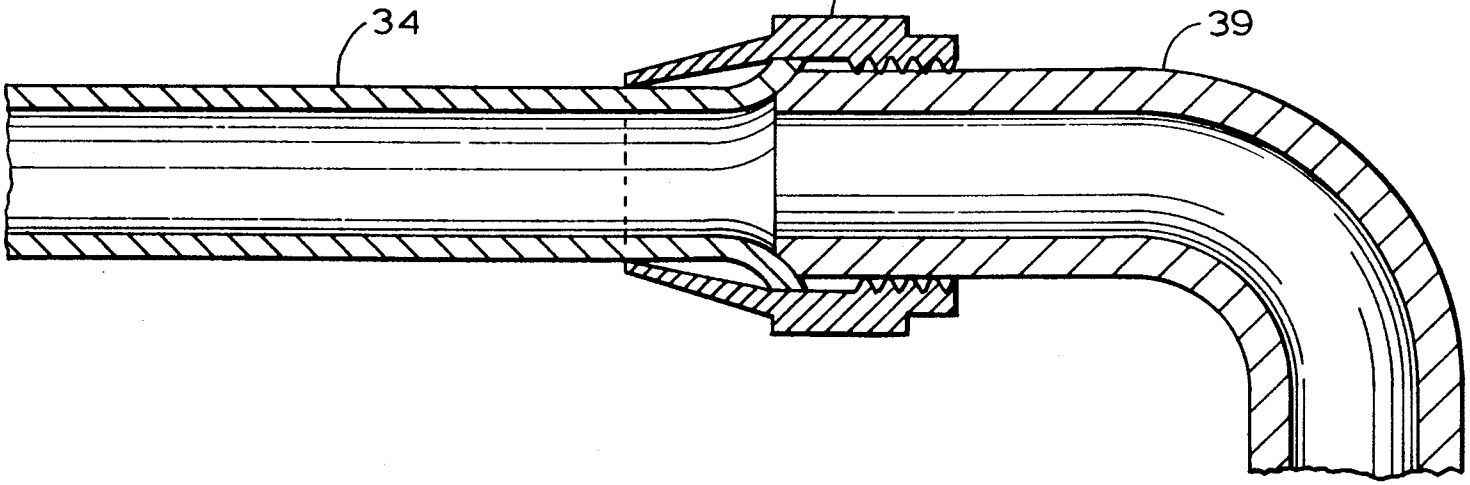
FIG. 3 is an enlarged fragmentary section of the pipe with the cleaning gun attached.

Referring more particularly to the drawings, the oil tank 10 communicates with the pump 12 through a conduit 14. The conduit 14 has a distant valve 16 and a near valve 18. The valve 16 is located at the oil tank reservoir 10 and valve 18 is located near the fuel pump 12 of the furnace 20. The fuel feed conduit and nozzle assembly 22 is shown leading from the pump to the furnace 20. The rigid pipe (not shown) is replaced by the fitting 24 which consists of a nipple 26, an elbow 28, a nipple 30 and an elbow 32 connected to a pipe 34 having a flared end 36. A coupling collar 38 engages the flared end 36 and threadingly engages the pipe nipple 40 communicating with the intake 41 of the pump 12. The flared end 36 and its collar 38 will, when uncoupled, receive the pipe 39 on the delivery end of a pressure blow-out tool (not shown). Collar 38 is preferably threaded on pipe 39. The pressure blow-out tool is of the type that delivers fluids under pressure, such as liquids or gases.

Before attaching the blow-out tool, the near valve 18 is closed, the coupling 38 opened, the blow-out tool or gun 39 is secured to coupling 38 against flared end 36.

Near valve 18 is reopened and the blow-out tool operated. Valve 18 is again closed to remove the blow-out tool, secure coupling 38 to nipple 40 and open near valve 18. The near valve 18 is in the area of work where it is handy to close and open before and after the blow out operation. Further, little or no oil is spilled because pump 12 and fitting 24 are higher than nipple 26 in the preferred configuration.

The flared end 36 of pipe 24 preferably is of softer material or metal than the collar 38 and nipple 40 to provide a better seal. Likewise, the fitting 39 of the blow-out gun may be of harder material or metal than flared end 36.

The position of a filter 42 is shown in dotted lines in the drawings but does not, per se, form a part of the invention since, while quite necessary, it is not essential in understanding the invention.

I claim:

1. For use in combination with a fuel consuming furnace, a fuel tank reservoir remotely located from said fuel consuming furnace, a pump located in close proximity to the furnace, a conduit connecting the pump to the furnace to feed said furnace, a fuel pipe line communicating upstream with the reservoir and communicating downstream with the pump, and a pressurized fluid cleaning tool having coupling means at the delivery end thereof, the improvement comprising:

a shut-off valve in the fuel pipe line in proximity to the pump, a disconnectable union in the fuel pipe line downstream of the shut-off valve and on the upstream side of the pump, said union having a flared end on the upstream end thereof, a rotatable collar engaging said flared end, coupling means on the downstream side of said collar, said flared end of said union and said coupling means on said collar comprising means for engaging and coupling with the delivery end of the tool and the coupling means at the delivery end thereof when said disconnectable union is disconnected from the upstream side of the pump, whereby access to the fuel line may be attained by closing said shut-off valve, disconnecting said union, coupling the cleaning tool said flared end and said collar, opening said valve and applying fluid pressure from the tool.

2. The mechanism set forth in claim 1 further characterized in that said collar is formed of harder material than said flared end and said pump means includes means for engaging said flared end, said means for engaging said flared end being of harder material than said flared end.

3. The combination of claim 1 further characterized in that said portion of the pipe line between the shut off valve and pump means is raised above the fuel pipe line connecting the remotely located tank and shut off valve.

4. The combination of claim 1 further characterized in that said disconnectable union is raised above the end of the fuel supply line upstream of said shut off valve.

5. The mechanism set forth in claim 1 wherein said rotatable collar is normally coupled to the upstream side of said pump means and is uncoupled therefrom to engage the coupling means of the tool.

* * * * *